US012605033B2

(12) United States Patent
Kim et al.

(10) Patent No.: US 12,605,033 B2
(45) Date of Patent: Apr. 21, 2026

(54) WASHING APPARATUS

(71) Applicant: LG ELECTRONICS INC., Seoul (KR)

(72) Inventors: Miseong Kim, Seoul (KR); Jaehoon Lee, Seoul (KR); Kangshin Kim, Seoul (KR); Serae Jo, Seoul (KR); Chunghoon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 145 days.

(21) Appl. No.: 18/274,305

(22) PCT Filed: Jan. 24, 2022

(86) PCT No.: PCT/KR2022/001240
§ 371 (c)(1),
(2) Date: Jul. 26, 2023

(87) PCT Pub. No.: WO2022/164158
PCT Pub. Date: Aug. 4, 2022

(65) Prior Publication Data

US 2024/0081607 A1 Mar. 14, 2024

(30) Foreign Application Priority Data

Jan. 27, 2021 (KR) ..... 10-2021-0011652

(51) Int. Cl.
*A47L 15/42* (2006.01)
*A47L 15/00* (2006.01)

(52) U.S. Cl.
CPC ..... *A47L 15/428* (2013.01); *A47L 15/0065* (2013.01); *A47L 15/4214* (2013.01)

(58) Field of Classification Search
None
See application file for complete search history.

(56) References Cited

U.S. PATENT DOCUMENTS 9,656,304 B2 * 5/2017 Tiwari ..... A61M 1/062

FOREIGN PATENT DOCUMENTS

| | | | |
|---|---|---|---|
| EP | 2 839 844 | A1 | 2/2015 |
| JP | 2018-19943 | A | 2/2018 |
| KR | 95-13467 | A | 6/1995 |
| KR | 10-2011-0114968 | A | 10/2011 |
| KR | 20-2013-0005454 | U | 9/2013 |
| KR | 10-1591608 | B1 | 2/2016 |
| KR | 10-1970520 | B1 | 4/2019 |
| KR | 10-2114048 | B1 | 5/2020 |
| WO | WO 2020/218777 | A1 | 10/2020 |

* cited by examiner

*Primary Examiner* — Rita P Adhlakha
(74) *Attorney, Agent, or Firm* — Birch, Stewart, Kolasch & Birch, LLP

(57) ABSTRACT

A washing apparatus includes a case defining an outer appearance and having therein a washing space to wash an object, a cradle supporting the object in the washing space, a first water nozzle spaced apart above the cradle and for spraying washing water upwards, and a second water nozzle provided in plurality, the plurality of second water nozzles spaced apart in different radial directions with respect to the first water nozzle and for spraying washing water inward of the first water nozzle.

15 Claims, 17 Drawing Sheets

WASHING APPARATUS

CROSS REFERENCE TO RELATED APPLICATIONS

This application is the National Phase of PCT International Application No. PCT/KR2022/001240, filed on Jan. 24, 2022, which claims priority under 35 U.S.C. 119(a) to Patent Application No. 10-2021-0011652, filed in the Republic of Korea on Jan. 27, 2021, all of which are hereby expressly incorporated by reference into the present application.

TECHNICAL FIELD

The present disclosure relates to a washing apparatus, and more particularly, to a washing apparatus for washing cups, containers, and other drinkware capable of containing liquid foods or the like.

BACKGROUND ART

Cups used at work or coffee shops as well as containers and baby bottles used at home are frequently used and therefore need to be cleaned individually and quickly. However, a dishwasher, which is a machine that can wash a large amount of tableware, including cups and containers, at once, cannot easily wash individual cups quickly. In addition, such a dishwasher has a spray nozzle for spraying washing water to a lower side of a rack, which makes it difficult to intensively wash areas that are particularly dirty or stained inside of cups.

Korean Laid-Open Patent Publication No. KR 10-2008-0016285, which is hereby incorporated by reference, discloses an apparatus exclusive for cleaning a cup. However, since the area for washing the cup and the area for rinsing the cup are separated, the cup cannot be washed and rinsed at cone, which causes the inconvenience. And even after washing and rinsing are completed, the cup remains undried.

Registered Utility Model No. KR 20-0471733, which is hereby incorporated by reference, discloses an apparatus for cleaning the inside and outside of a cup while the cup is upright. However, in such a structure, only washing can be performed, and rinsing or drying cannot be performed. Also, washing is limited to a specific size or type of cup, so various cups or containers cannot be washed.

In addition, the aforementioned apparatuses use a separate brush or cleaning blades to wash the inside of a cup, etc. Such a washing method may cause damage to an object to be washed, such as a cup, due to friction on an inner surface of the cup. Also, since only the inside of the cup is mainly washed, it may be difficult to remove contamination (e.g., stains) on the outside of a lip of the cup where contamination mainly occurs, in addition to the inside of the cup.

Further, since the apparatuses are designed for structural washing, debris or residue, water stains, and the like inside the cup may not be effectively sterilized and cleaned.

SUMMARY OF THE DISCLOSURE

It is an objective of the present disclosure to provide a washing apparatus that can intensively wash an inner space (e.g., interior surface) of an object to be washed (e.g., a cup), which is an area that can be particularly dirty or stained.

It is another objective of the present disclosure to provide a washing apparatus that can wash main dirty or stained areas of an object to be washed, as well as a dirty or stained area on the inside of the object to be washed.

It is another objective of the present disclosure to provide a washing apparatus that can wash a wide range of areas that are dirty or stained on the outside of an object to be washed.

The objectives of the present disclosure are not limited to the objectives described above, and other objectives not stated herein will be clearly understood by those skilled in the art from the following description.

According to one aspect of the subject matter described in this application, a washing apparatus includes: a case defining an outer appearance and having therein a washing space to wash an object; a cradle to allow the object to be placed in the washing space; a first water nozzle spaced apart above the cradle and configured to spray washing water upward; and a second water nozzle provided in plurality, the plurality of second water nozzles being disposed spaced apart in different radial directions with respect to the first water nozzle and being configured to spray washing water inward where the first water nozzle is disposed. Thus, an inner surface of the object may be intensively washed with the first water nozzle, and an outer circumferential surface of a lip of the object may be intensively washed with the second water nozzle.

The second water nozzle may be spaced upward from the cradle, allowing an outer circumferential surface of a lip of the object to be intensively washed.

The first water nozzle may be disposed at a higher position than the second water nozzle, thereby washing an inner space of the object.

The first water nozzle may have a hemispherical shape convex upward and may be provided with a plurality of first spray holes to spray washing water in different directions at different positions, thereby washing various parts of an inner space of the object.

The plurality of first spray holes may include a 1-1 spray hole formed at a center of the hemispherical shape and a plurality of 1-2 spray holes disposed spaced apart in different directions with respect to the 1-1 spray hole, thereby washing various parts of an inner space of the object.

The washing apparatus may further include a first water supply pipe to supply washing water to the first water nozzle, and a nozzle support to support the first water supply pipe disposed therein, the nozzle support being disposed to protrude above the cradle. The first water nozzle may be disposed at an upper end of the nozzle support, allowing the first water nozzle to be disposed above the cradle.

The cradle may include an outer grille defining an edge and an inner grille perpendicularly intersecting each other on an inside of the outer grille. The cradle may be provided at a center thereof with a nozzle hole through which the nozzle support passes, allowing the first water nozzle to be disposed above the cradle.

The washing apparatus may further include a nozzle frame having an annular shape and spaced apart from the nozzle support in a radial direction. The plurality of second water nozzles may be disposed on an inner circumferential surface of the nozzle frame, so that the plurality of second water nozzles may be disposed to wash an outer circumferential surface of a lip of the object.

The plurality of second water nozzles may be spaced apart from each other in a circumferential direction defined by the nozzle frame, and the plurality of second water nozzles may each have a hemispherical shape convex in a direction in which the nozzle support is disposed, allowing washing water to be sprayed in various directions at an inner space of the object.

The second water nozzle may have a plurality of second spray holes to spray washing water in different directions at different positions, allowing washing water to be sprayed in various directions at an inner space of the object.

The washing apparatus may further include a third water nozzle disposed at an upper side of the washing space and configured to spray washing water downward, thereby washing an outer surface of the object.

The nozzle frame may be disposed around the cradle, and the second water nozzle may spray washing water in a direction in which the nozzle support is disposed, allowing an outer circumferential surface of the object to be washed by the plurality of second water nozzles.

The washing apparatus may further include a rotating member rotatably disposed under the third water nozzle and configured to scatter washing water sprayed from the third water nozzle in a radial direction, allowing washing water to be sprayed to an outer surface of the object.

The washing apparatus may further include a nozzle frame supporting the arrangement of the second water nozzle that sprays washing water toward a center from a lower side of the washing space and the third water nozzle that sprays washing water downward from the upper side of the washing space, allowing the second water nozzle and the third water nozzle to be securely positioned.

The nozzle frame may include: a first frame radially spaced apart from a nozzle support that is disposed to protrude above the cradle and has an upper end at which the first water nozzle is disposed, the first frame being provided with the plurality of second water nozzles; and a second frame extending upward from one side of the first frame and provided with the third water nozzle.

The plurality of second water nozzles may be disposed at the same height on an inner circumferential surface of the first frame having a ring shape, allowing an outer circumferential surface of a lip of the object to be intensively washed.

The second frame may include a vertical frame extending upward from the first frame, and a horizontal frame bent from an upper end of the vertical frame to extend above the nozzle support. The third water nozzle may be disposed at an end portion of the horizontal frame, thereby spraying washing water toward the first water nozzle from above the first water nozzle.

According to another aspect, a washing apparatus includes: a case defining an outer appearance and having therein a washing space to wash an object; a cradle to allow the object to be placed in the washing space; a first water nozzle spaced apart above the cradle and configured to spray washing water upward at an inner space of the object; and a second water nozzle spaced upward from the cradle and configured to spray washing water to an outer circumferential surface of a lip of the object. Thus, an inner surface of the object may be intensively washed with the first water nozzle, and an outer circumferential surface of a lip of the object may be intensively washed with the second water nozzle.

The washing apparatus may further include a third water nozzle disposed above the object to spray washing water downward. Thus, an outer circumferential surface of a lip of the object may be washed with the third water nozzle.

According to another aspect, a washing apparatus includes: a case defining an outer appearance and having therein a washing space to wash an object; a cradle to allow the object to be placed in the washing space; a first water nozzle spaced apart above the cradle and configured to spray washing water upward; and a third water nozzle disposed at an upper side of the washing space and configured to spray washing water downward. Thus, an inner surface of the object may be intensively washed with the first water nozzle, and an outer surface of the object may be intensively washed with the third water nozzle.

The washing apparatus may further include a rotating member rotatably disposed under the third water nozzle and configured to scatter washing water sprayed from the third water nozzle in a radial direction, allowing an outer surface of the object to be washed entirely.

Details of other embodiments are included in the detailed description and the accompanying drawings.

Advantageous Effects

A washing apparatus of the present disclosure has one or more of the following effects.

First, as a first water nozzle is spaced apart above a cradle and is disposed at an inner space of an object to be washed to spray washing water to an inner surface of the object to be washed, the inner surface of the object to be washed, which is an area that is particularly dirty or stained, can be washed intensively. Also, as a separate cleaning brush is not required, objects can be washed regardless of the size, and the inner surface of an object to be washed is not damaged by friction after washing.

Second, as a second water nozzle is disposed, above the cradle, around an object to be washed and sprays washing water in a direction of the outer circumferential surface of a lip or rim of the object to be washed, contamination (e.g., stains) on the lip of the object to be washed can be intensively washed.

Third, as a third water nozzle scatters and sprays washing water in a downward direction, where an object to be washed is placed, from above the object to be washed, the entire outer surface of the object to be washed can be cleaned evenly.

The effects of the present disclosure are not limited to the effects described above, and other effects not stated in the above will be clearly understood by those skilled in the art from the claims.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE EMBODIMENTS

Figure 1:
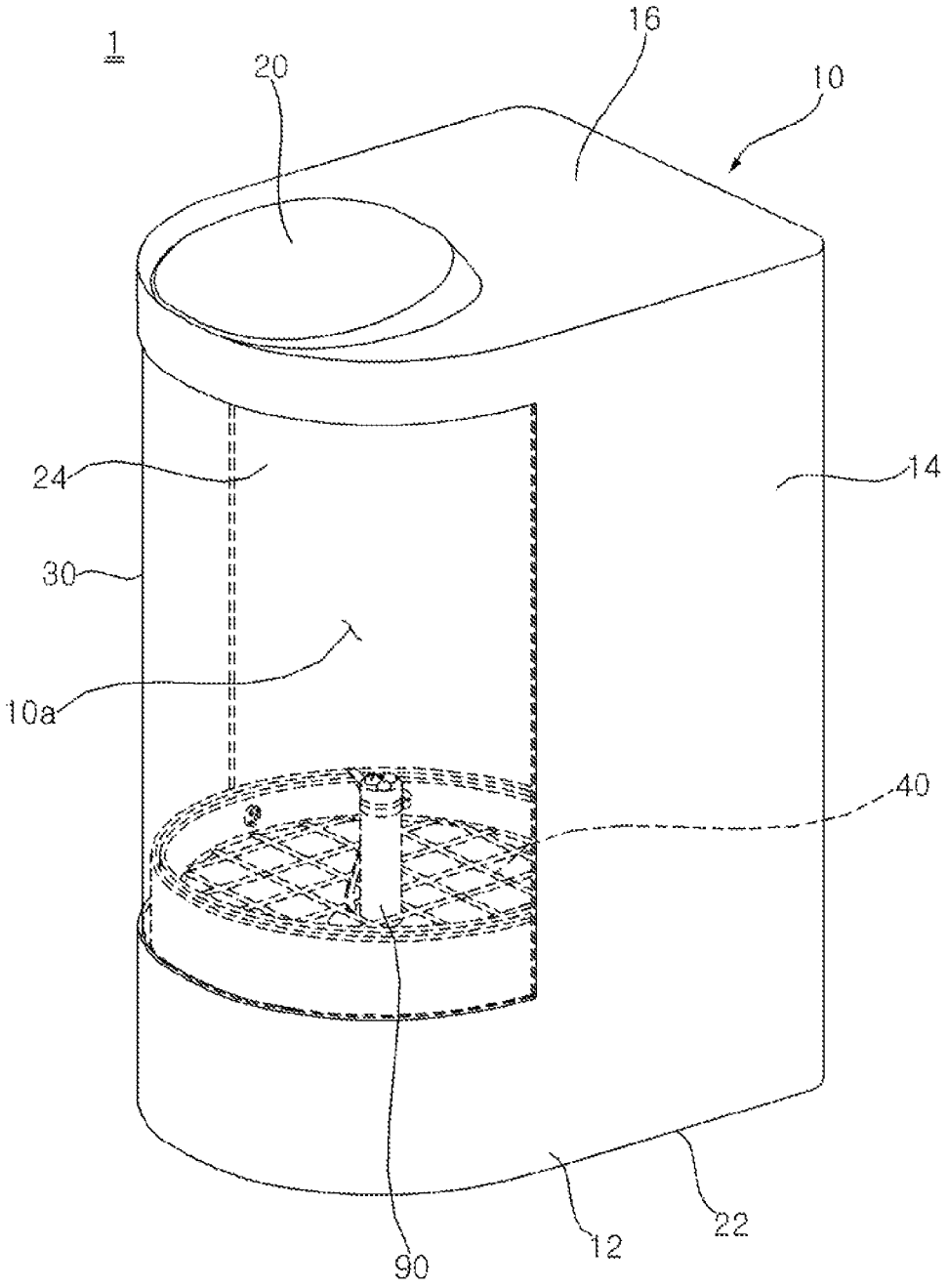
FIG. 1 is a perspective view of a washing apparatus according to an embodiment of the present disclosure.

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Hereinafter, a washing apparatus according to an embodiment of the present disclosure will be described with reference to FIGS. 1 to 13.

Figure 2:
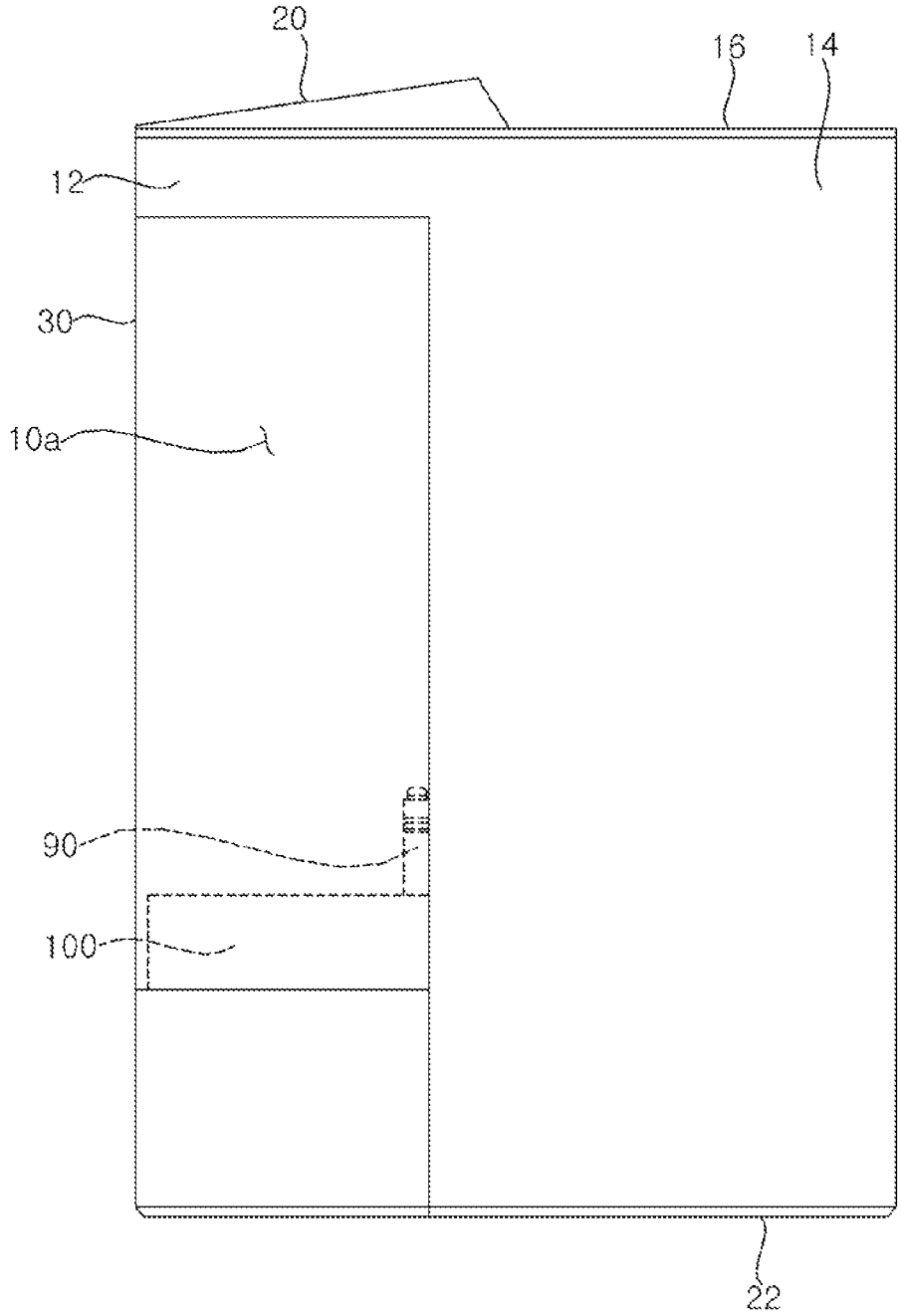
FIG. 2 is a side view of a washing apparatus according to an embodiment of the present disclosure.
Figure 3:
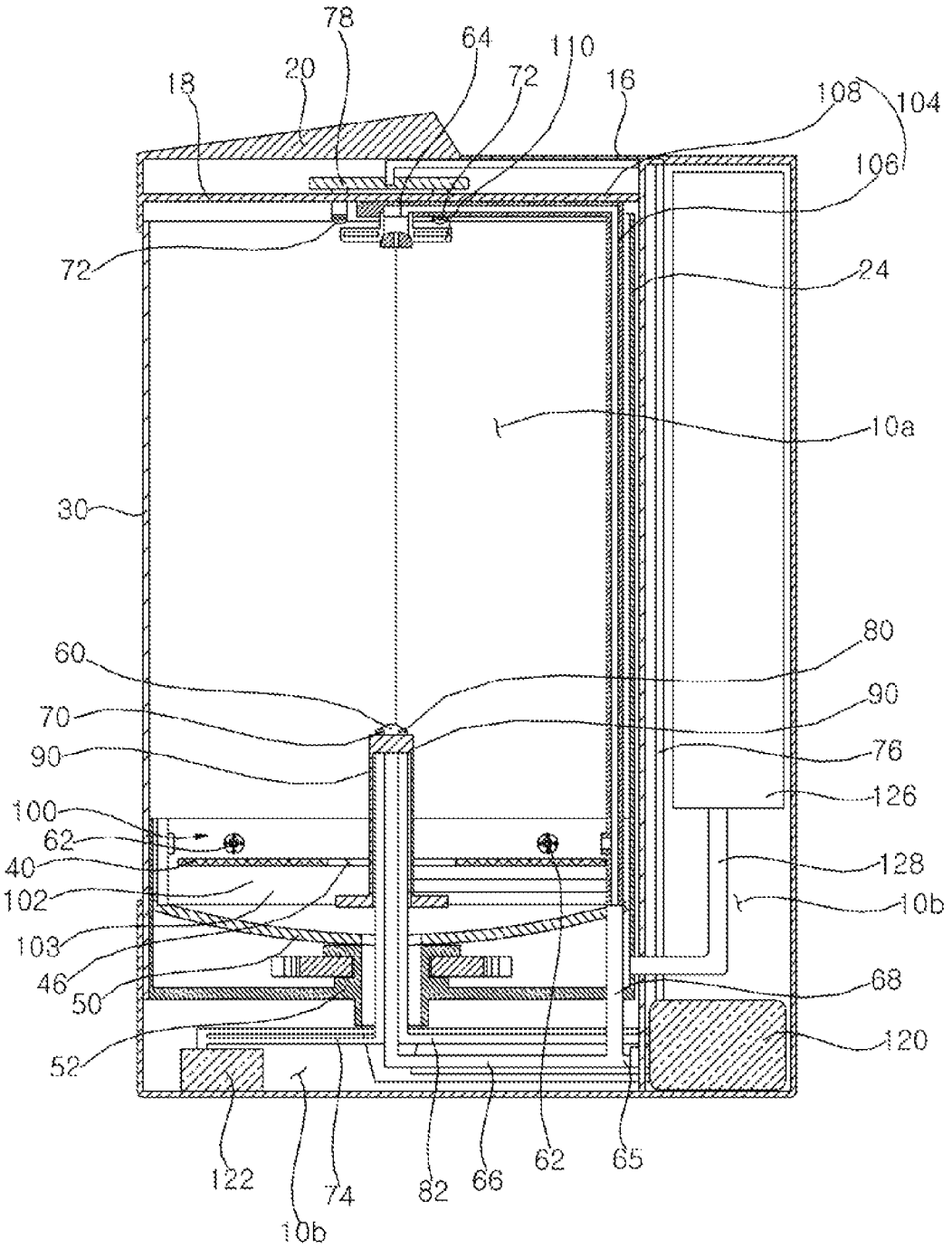
FIG. 3 is a side cross-sectional view schematically illustrating a washing apparatus according to an embodiment of the present disclosure.

Referring to FIGS. 1 to 3, a washing apparatus 1 according to the present disclosure includes a case 10 defining an outer appearance and having a washing space 10*a* and a mechanical chamber 10*b* therein, a door 30 to cover an open front surface of the case 10, a cradle 40 on which an object to be washed (hereinafter referred to as an 'object') is placed to allow the object to be disposed inside the washing space 10*a*, a water nozzle (60, 62, 64) configured to spray washing water to the washing space 10*a*, an air nozzle (70, 72) configured to spray air to the washing space 10*a*, and a steam nozzle 80 configured to spray steam to the washing space 10*a*. The washing apparatus 1 includes a sump 50 disposed below the cradle 40 to collect washing water falling down to the cradle 40.

Figure 14:
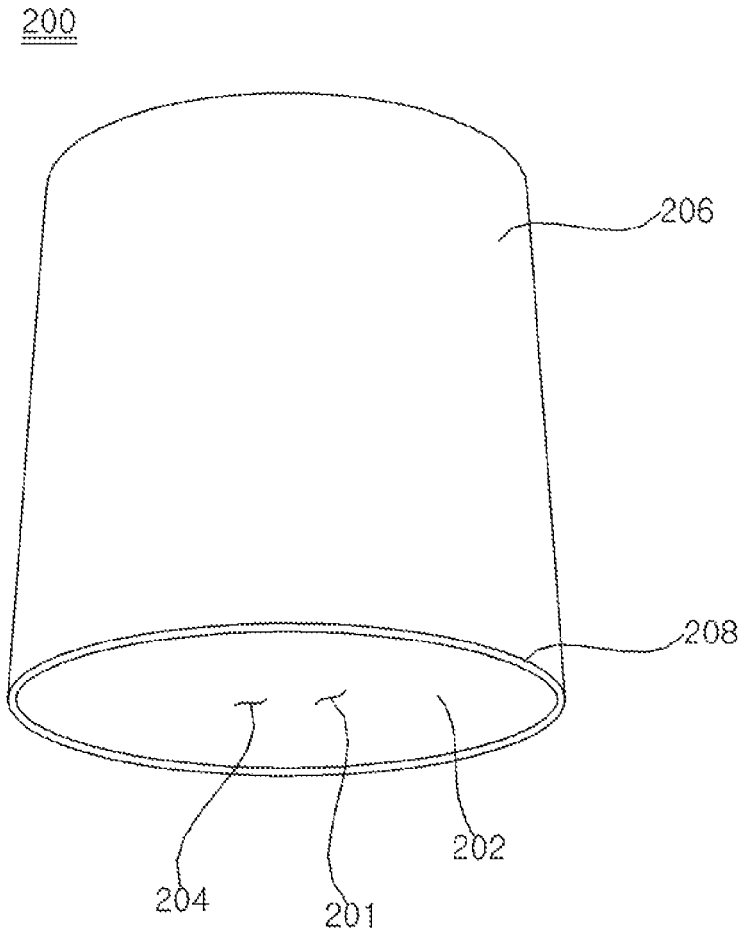
FIG. 14 is a view for explaining an object to be washed that can be placed into the washing apparatus of the present disclosure.

Referring to FIG. 14, an object 200 placed in the washing space 10*a* of the washing apparatus 1 may have an opening 201 in one direction, and may have a convex shape in one direction of the opening 201. Accordingly, the object 200 may have an inner space 204, which is defined by an inner surface 202, capable of containing liquids, etc. In addition, an outer surface 206 is formed on a surface where the inner space 204 is not defined. The object 200 may have a lip 208 where the inner surface 202 and the outer surface 206 are connected around the opening 201. The outer surface 206 includes a bottom surface that is opposite to the opening 201.

The object used in the present disclosure can be used for drinkware (e.g., beverageware, such as a cup, a baby bottle, etc.) having an inner space to contain liquids. The object shown in FIG. 14 is one example, and the present disclosure can be applicable to other drinkware having an inner space defined by an inner surface. The object may be required to have a size that allows a nozzle support 90, which will be described later, to be inserted into the inner space.

Referring to FIGS. 1 to 3, the case 10 defines the outer appearance and has therein the washing space 10*a* in which an object is placed. The case 10 may be provided therein with the washing space 10*a* in which an object is placed and a mechanical chamber 10*b* in which a component that supplies water, steam, or air to the washing space 10*a* is disposed.

The case 10 includes a front case 12 that is disposed at the front and has a door hole in which the door 30 is disposed, a rear case 14 that is disposed behind the front case 12 and defines the mechanical chamber 10*b* therein, a top cover 16 that covers the top of the front case 12 and the top of the rear case 14, and a bottom cover 22 that covers the bottom of the front case 12 and the bottom of the rear case 14. The case 10 includes an inner case 24 that is disposed inside the front case 12 and defines the washing space 10*a* together with the door 30.

The front case 12 is provided with the door hole having a semi-cylindrical shape and having one side on which the door 30 is disposed. An inner lower portion of the front case 12 is connected to an inner lower portion of the rear case 14 to define a space in which a device configured to supply steam or washing water to the washing space is disposed.

The front case 12 is disposed in front of the rear case 14 and defines a curved surface that forms a convex shape in a forward direction.

The rear case 14 is disposed behind the front case 12, and can have a substantially cuboid shape. The inner case 24 may be disposed inside the rear case 14. The washing space 10*a* may be formed at the front of the inner case 24, and the mechanical chamber 10*b* may be formed at the rear of the inner case 24. The rear case 14 may define therein the mechanical chamber 10*b* in which a device for supplying steam and/or washing water to the washing space is disposed. The mechanical chamber 10*b* may be formed in a space between the rear case 14 and the inner case 24.

The top cover 16 covers an upper side of the case 10. The top cover 16 may be provided with an input panel 20 for inputting a command regarding the operation of the washing apparatus 1. The input panel 20 may be provided with a display (e.g., touchscreen) for displaying an operating state of the washing apparatus 1.

The inner case 24 may have a semi-cylindrical shape corresponding to the door 30. The inner case 24 may define, together with the door 30, the washing space 10*a*. The washing space 10*a* defined by the inner case 24 and the door 30 may have a cylindrical shape.

Figure 9:
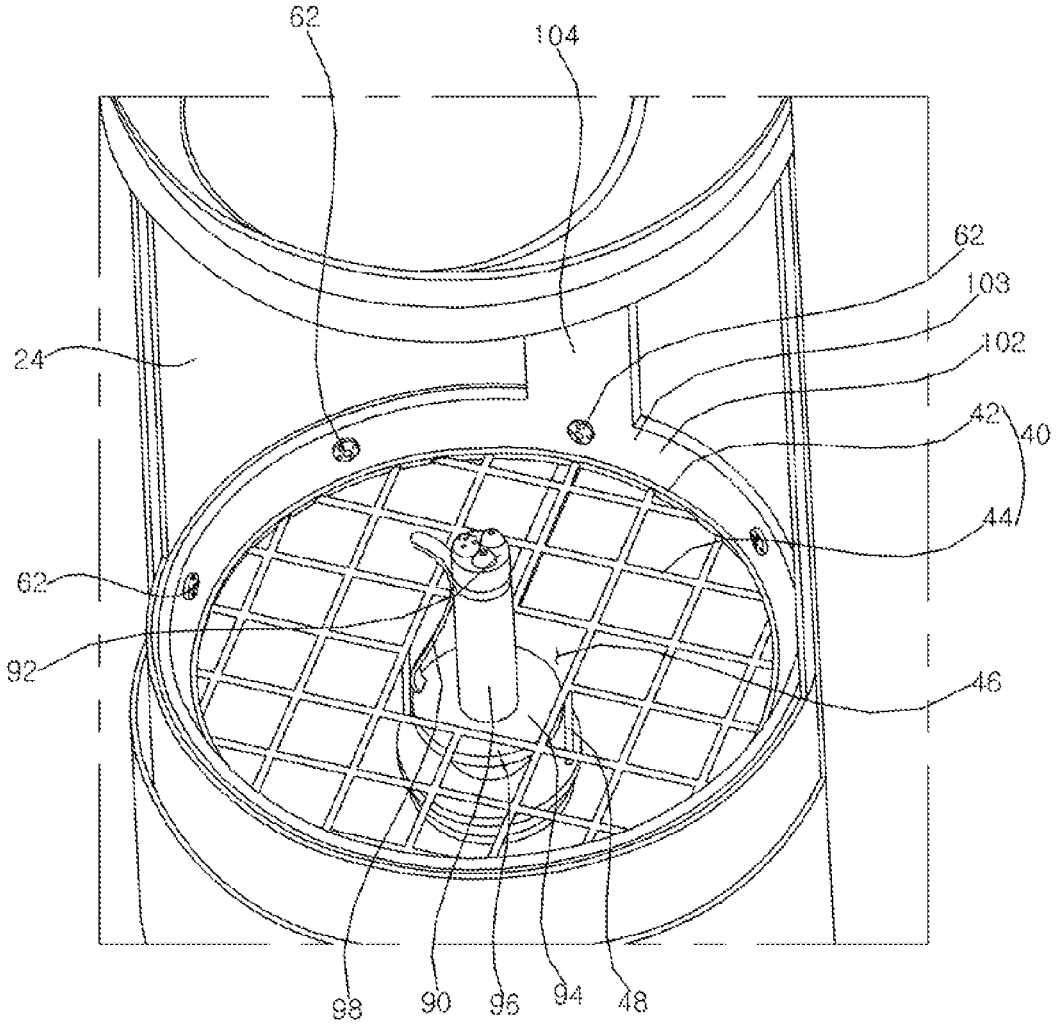
FIG. 9 is a view for explaining the arrangement and shape of a cradle and a nozzle support, according to an embodiment of the present disclosure.

Referring to FIG. 1, the cradle 40 on which an object is placed may be disposed at a lower side of the washing space 10*a*. Referring to FIG. 9, the cradle 40 may include a plurality of grilles 42 and 44 having a disk shape and perpendicularly intersecting each other. The cradle 40 may include an outer grille 42 defining an edge or rim, and an inner grille 44 perpendicularly intersecting each other on the inside of the outer grille 42. The inner grille 44 includes a plurality of linear elements that intersect one another at a 90° angle. However, the plurality of linear elements can intersect one another at various angles, and is not limited to a 90° angle.

Referring to FIG. 9, the cradle 40 may be provided at its center with a nozzle hole 46 through which a first water nozzle 60 is disposed. The first water nozzle 60 can extend to any height within the washing space 10*a*. The cradle 40 may further include a vertical rib 48 extending downward from the inner grille 44 and connected to the sump 50. Further, the vertical rib 48 can be provided in plurality and can be utilized to space the cradle 40 from the sump 50.

Referring to FIG. 3, the sump 50 can be for temporarily storing washing water and is disposed below the cradle 40. The sump 50 is formed in a funnel shape so as to collect washing water falling from the washing space 10*a*.

Referring to FIG. 3, the sump 50 is provided at its center with a water collecting pipe 52 to transfer water collected in the sump 50 to a water pump 120. The water collecting pipe 52 is spaced downward from the nozzle support 90 by a predetermined distance. The water collecting pipe 52 may be provided therein with a steam supply pipe 82, a first water supply pipe 66, and a first air supply pipe 74. A passage (or flow path) formed in the water collecting pipe 52 is larger in size than the steam supply pipe 82, the first water supply pipe 66, and the first air supply pipe 74, thereby defining therein a space in which water moving downward through the sump 50 flows. A lower end of the water collecting pipe 52 may be connected to the water pump 120.

Referring to FIG. 3, the mechanical chamber 10*b* may be disposed in a lower space of the front case 12, a lower space of the rear case 14, and a rear space of the inner case 24 disposed in the rear case 14.

Referring to FIGS. 1 to 3, the door 30 covers the door hole of the front case 12, which is open. The door 30 may have a shape corresponding to the door hole defined by the front case 12. The door 30 may have a semi-cylindrical shape.

The door 30 may have a shape corresponding to the inner case 24. The door 30 may have the same center of curvature as the inner case 24. However, the door 30 may have a smaller radius of curvature than the inner case 24. Therefore, when the door hole is opened by the door 30, the door 30 may be disposed inside the inner case 24.

The door 30 is disposed inside the front case 12. A vertical length of the door 30 is greater than a vertical length of the door hole. Accordingly, an upper end and a lower end of the door 30 may be disposed inside the front case 12. Thus, water scattered in the washing space 10*a* may fall into the sump 50 without leaking to the outside through the door 30.

Figure 4A:
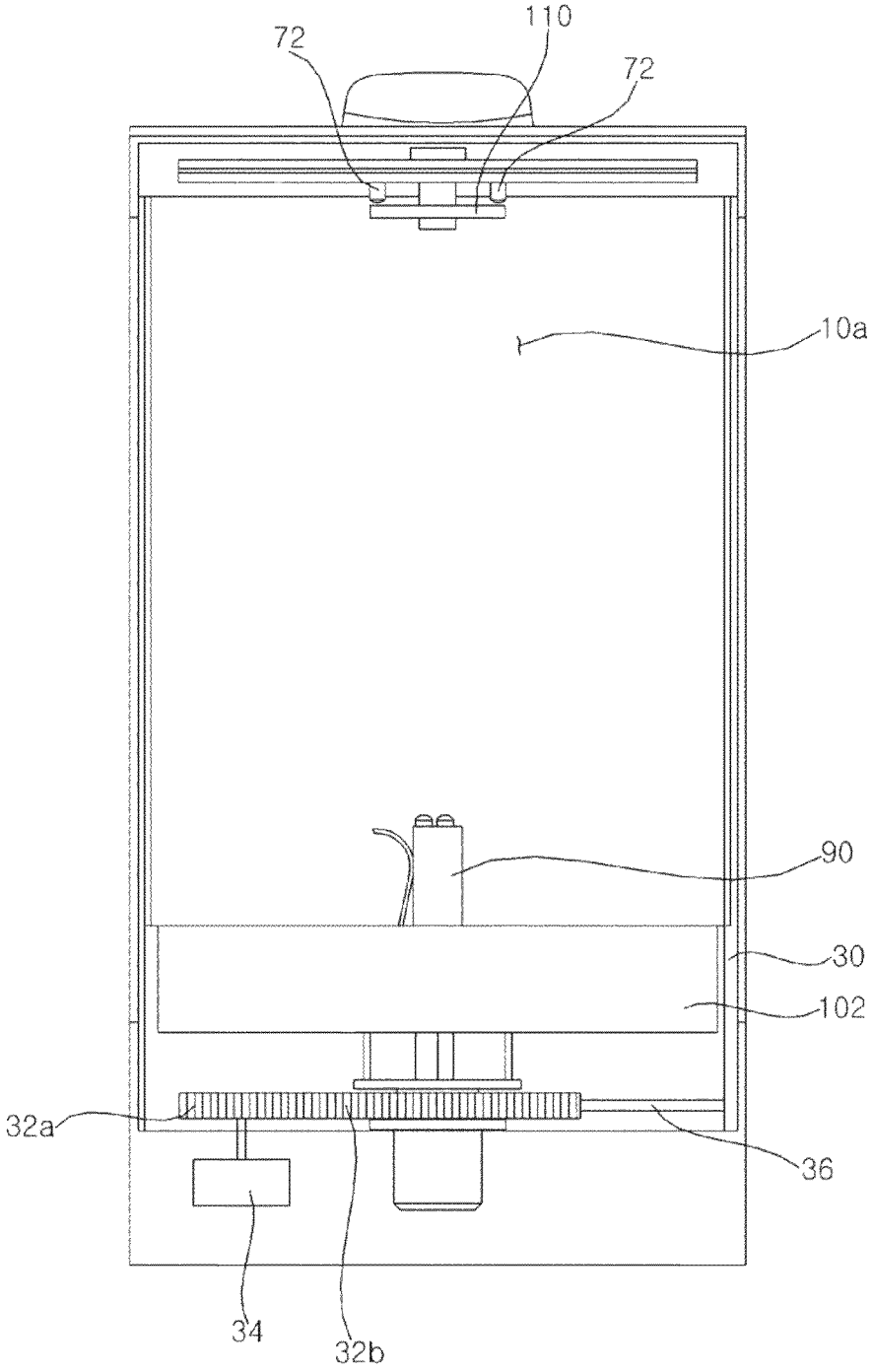
FIG. 4A is a view for explaining an opening and closing structure of a door, according to an embodiment of the present disclosure.

The washing apparatus 1 may include a door gear (32*a*, 32*b*) to allow the door 30 to change in position, and a door motor 34 to cause the door gear to rotate. Referring to FIG. 4A, the door gear includes a first door gear 32*a* mounted on the door motor 34 to rotate, and a second door gear 32*b* configured to rotate in mesh with the first door gear 32*a*. That is, the second door gear 32*b* meshes with the first door gear 32*a*, such that rotation of the first door gear 32*a* by the door motor 34 directly causes the second door gear 32*b* to rotate. The first door gear 32*a* and the second door gear 32*b* are disposed at a lower central side of the washing space. The second door gear 32*b* is rotatably disposed on the water collecting pipe 52 provided at a center of a lower portion of the washing space 10*a*. The second door gear 32*b* may have the shape of a spur gear, and may rotate on the water collecting pipe 52.

The washing apparatus 1 may further include a door bridge 36 to connect the second door gear 32*b* and the door 30. The door bridge 36 may extend from the door gear 32 in a radial direction, so as to be connected to the door 30.

Figure 4B:
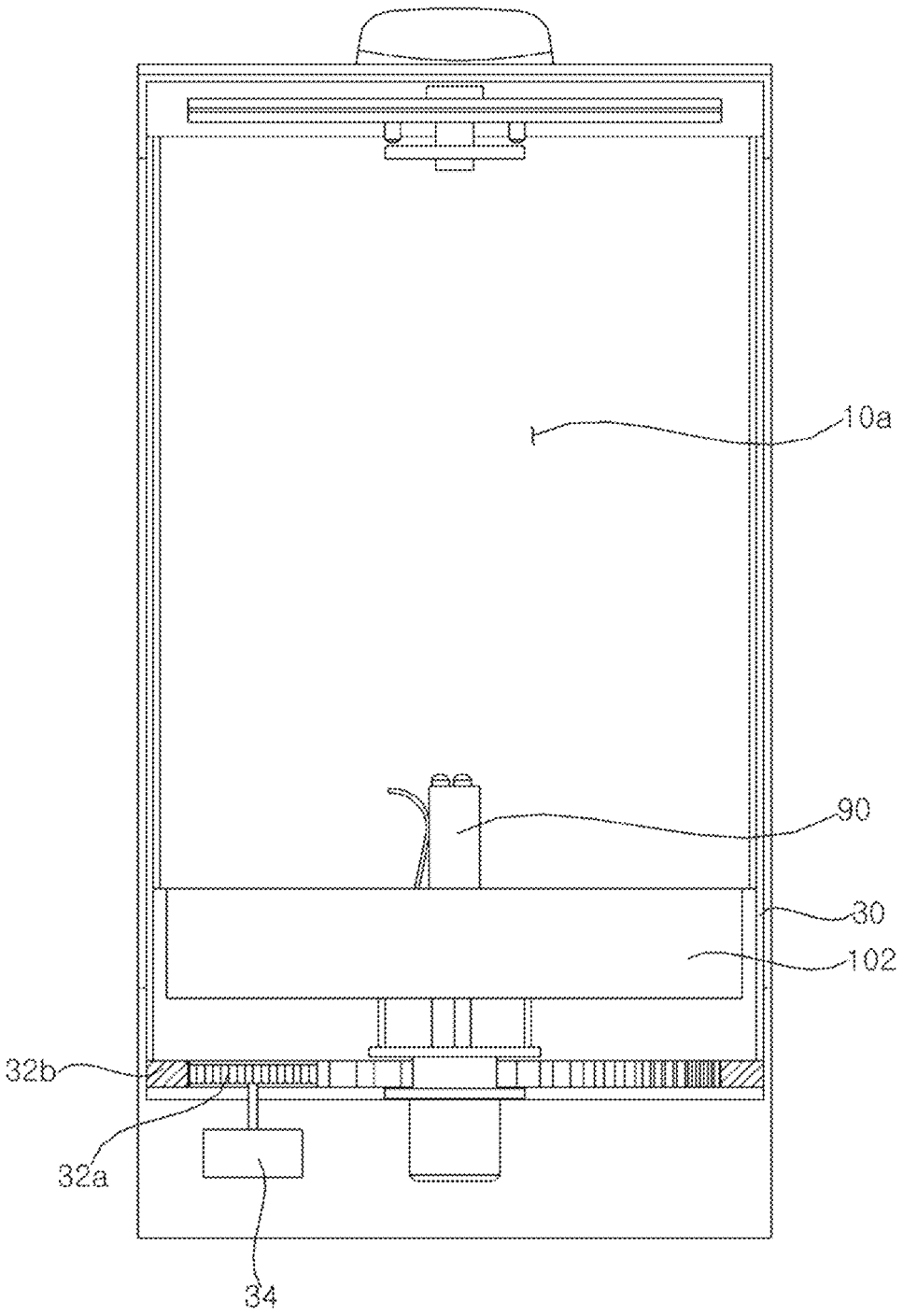
FIG. 4B is a view for explaining an opening and closing structure of a door, according to another embodiment of the present disclosure.

Referring to FIG. 4B, a door 30 of the washing apparatus 1 according to another embodiment, which shows a structure for modifying the disposition of the door 30, may include a door motor 34, a first door gear 32*a* mounted on the door motor 34 to rotate, and a second door gear 32*b* provided on an inner circumferential surface of the door 30. The second door gear 32*b* is configured as a rack gear, and is formed in a circumferential direction of the door 30.

Figure 6:
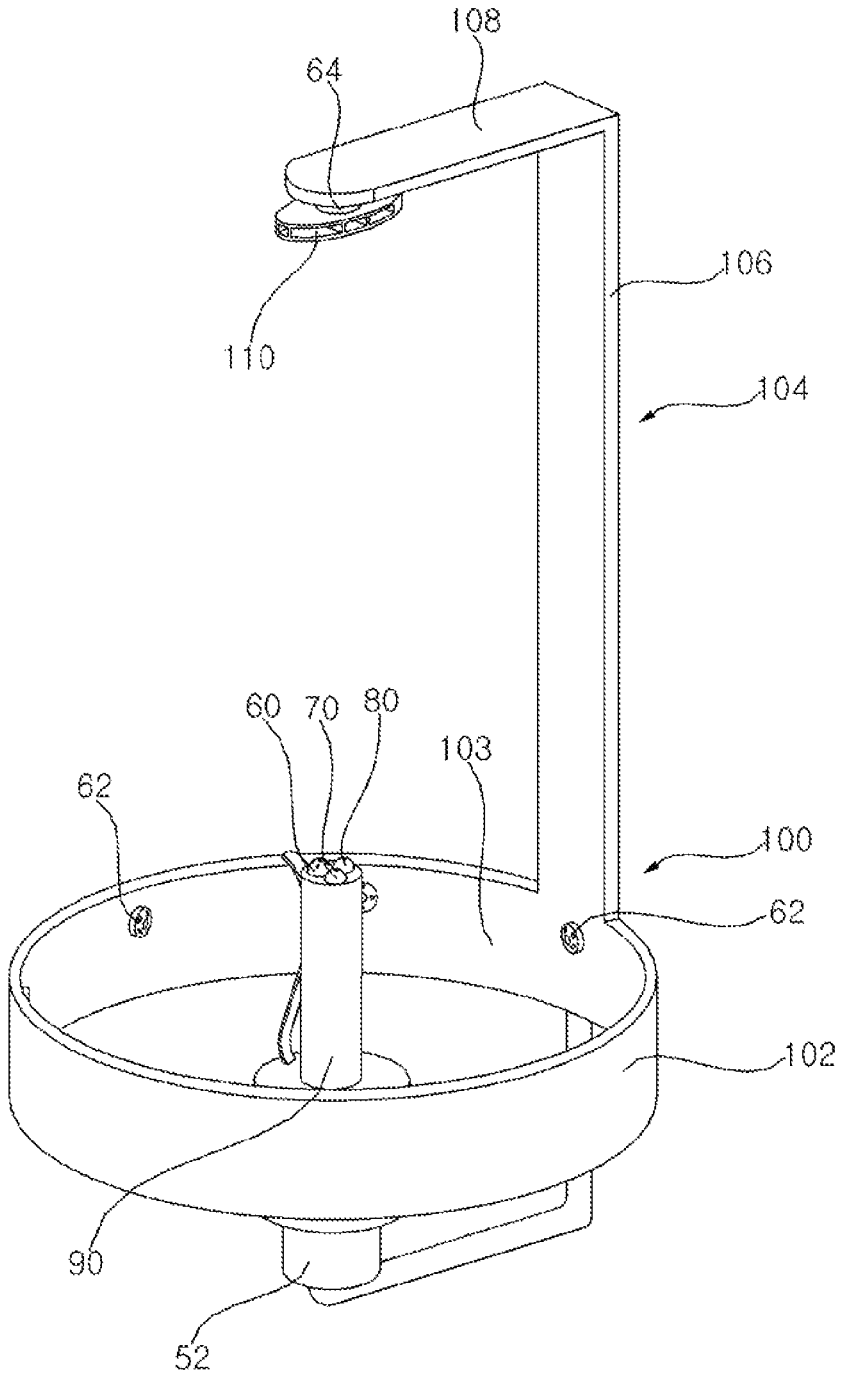
FIG. 6 is a view for explaining the arrangement and shape of a nozzle support and a nozzle frame, according to an embodiment of the present disclosure.

Referring to FIG. 6, the water nozzle may include a first water nozzle 60 configured to spray washing water to an inside of an object, a second water nozzle 62 configured to spray washing water to an outer circumferential surface of a lip of the object, and a third water nozzle 64 configured to spray washing water to an outside of the object. The second water nozzle 62 can be provided in plurality and the plurality of second water nozzles 62 can be disposed on a circumferential surface 103 of a first frame 102, and can be spaced from one another.

When an object is placed in the washing space 10*a*, the first water nozzle 60 is disposed at an inner space of the object. The first water nozzle 60 is disposed at the inner space of the object to spray washing water upward.

Referring to FIG. 6, the first water nozzle 60 is disposed to spray washing water upward at a position spaced upward from a lower center of the washing space. The first water nozzle 60 is positioned higher than the second water nozzle 62, and is disposed to spray washing water upward.

Figure 12:
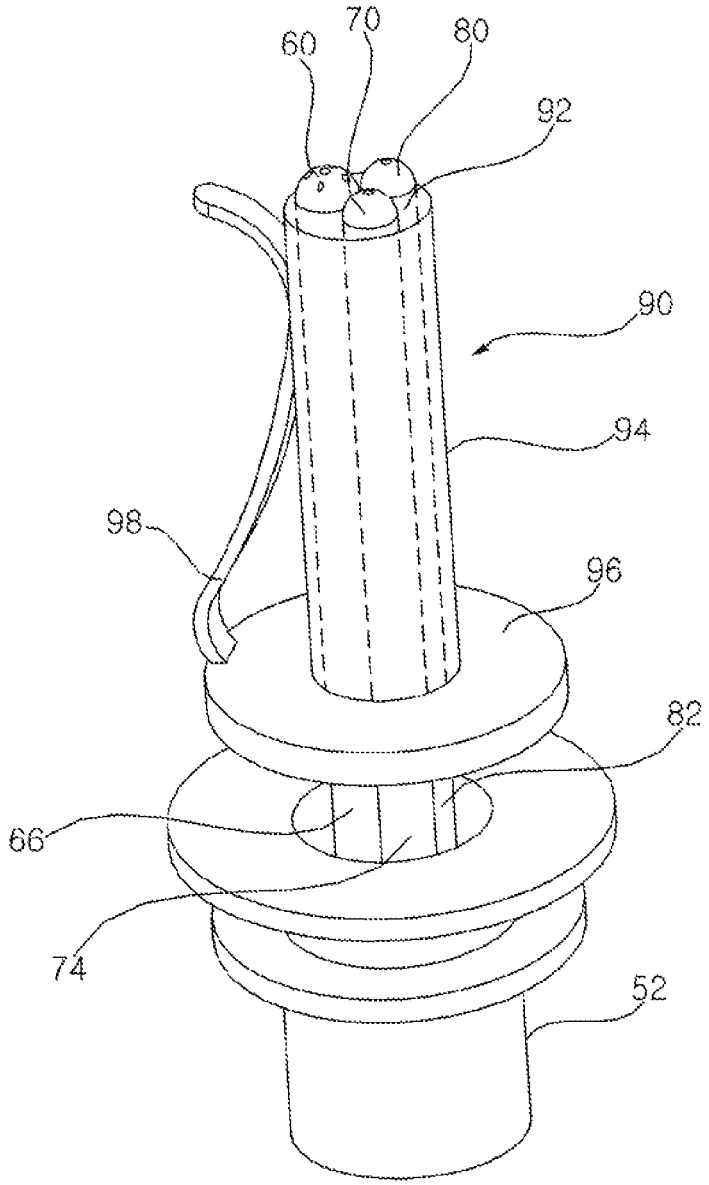
FIG. 12 is a view for explaining a nozzle support, a first water nozzle, a first air nozzle, and a steam nozzle, according to an embodiment of the present disclosure.
Figure 13:
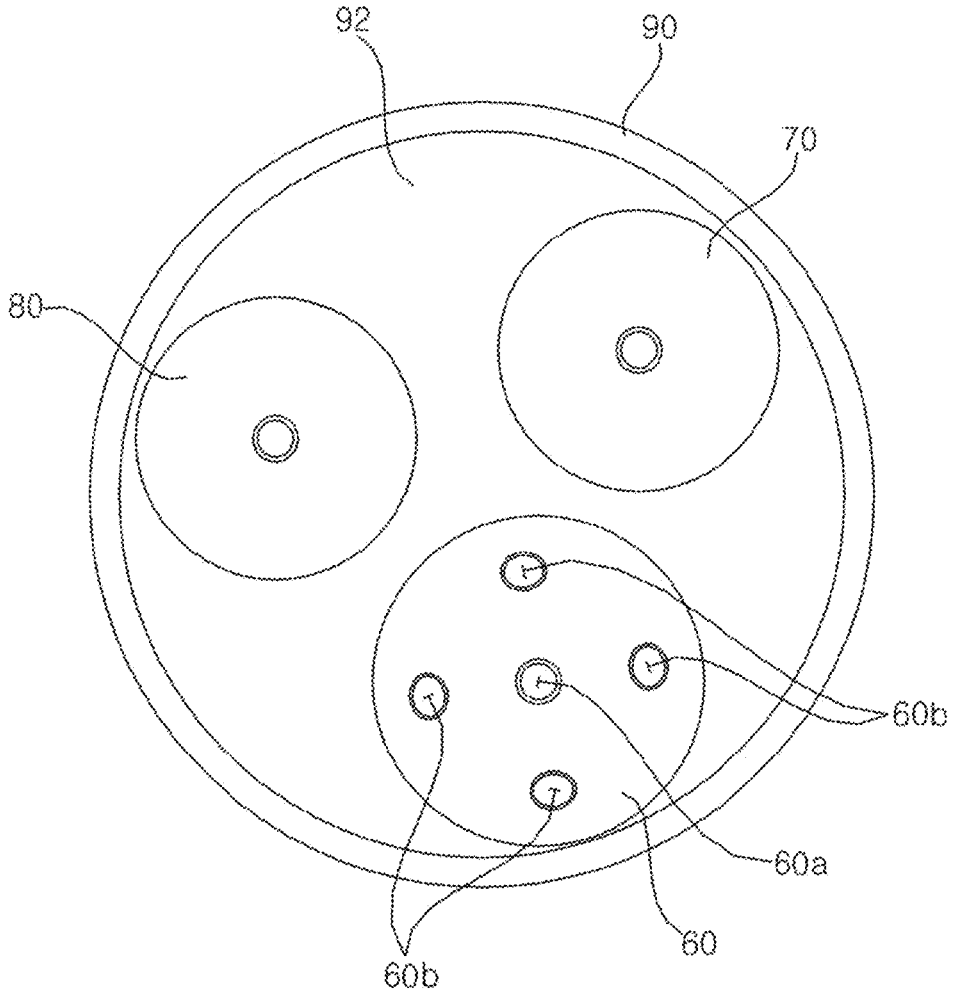
FIG. 13 is a view for explaining the arrangement and shape of a first water nozzle, a first air nozzle, and a steam nozzle that are disposed at the upper end of a nozzle support, according to an embodiment of the present disclosure.

The first water nozzle 60 is disposed on an upper surface of the nozzle support 90 to be described later. Referring to FIG. 12, the first water nozzle 60 may have a hemispherical shape convex upward. Referring to FIG. 13, the first water nozzle 60 may have a plurality of first spray holes 60*a* and 60*b* through which washing water is sprayed. The plurality of first spray holes 60*a* and 60*b* formed in the first water nozzle 60 may be provided at different positions to face different directions. The plurality of first spray holes 60*a* and 60*b* formed in the first water nozzle 60 may be open to face different directions. Referring to FIG. 13, the first water nozzle 60 may have a 1-1 spray hole 60*a* (e.g., a single spray hole or a first first spray hole) formed at a center of the hemispherical shape, and a plurality of 1-2 spray holes 60*b*

(e.g., a pair of spray holes or second first spray holes) disposed spaced apart in different directions with respect to the 1-1 spray hole 60*a*.

As the plurality of spray holes 60*a* and 60*b* are formed in the first water nozzle 60, washing water may be sprayed in various directions of the inner space of an object.

The second water nozzle 62 may spray washing water to an outer circumferential surface of a lip of an object placed in the washing space 10*a*. In the case of an object (e.g., a cup), contamination (e.g., residues or stains) on an outer circumferential surface of a lip of the object may be frequently caused due to contact. Therefore, the second water nozzle 62 sprays washing water toward the outer circumferential surface of the lip of the object to remove the contamination from the object.

Figure 10:
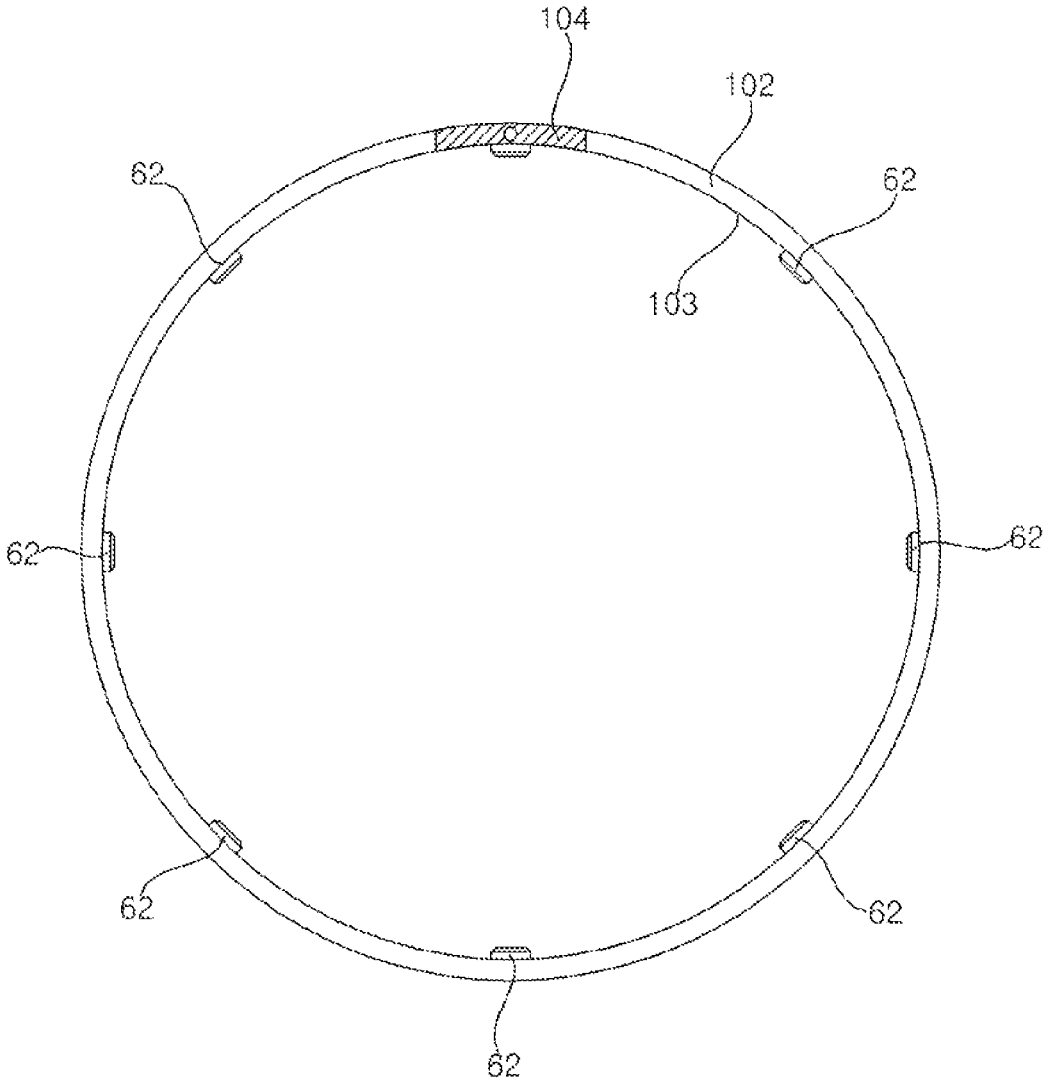
FIG. 10 is a view for explaining the arrangement of a plurality of second water nozzles, according to an embodiment of the present disclosure.
Figure 11:
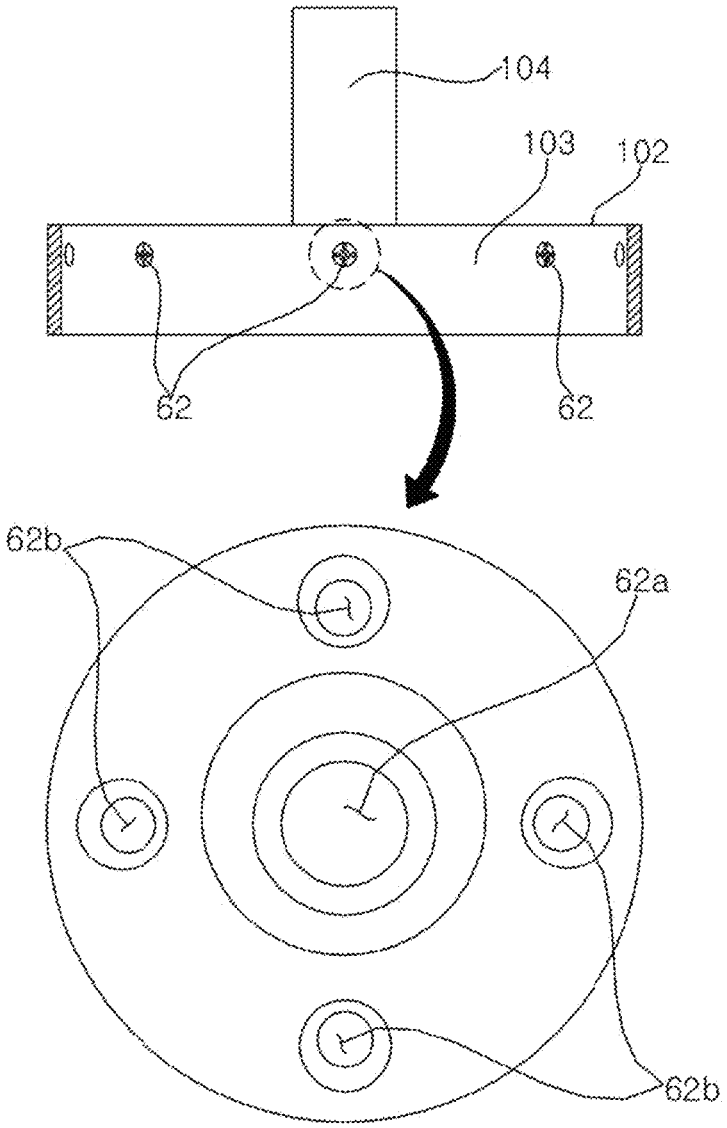
FIG. 11 is a view for explaining the arrangement and shape of a second water nozzle, according to an embodiment of the present disclosure.

Referring to FIGS. 10 and 11, the second water nozzle 62 is disposed on an inner circumferential surface 103 of a first frame 102 to be described later. The second water nozzle 62 can be provided in plurality. The plurality of second water nozzles 62 are spaced apart from each other in a circumferential direction on the inner circumferential surface 103 of the first frame 102. The plurality of second water nozzles 62 are disposed to spray washing water toward a center (or central portion) where the nozzle support 90 is disposed.

The second water nozzle 62 is spaced upward from a surface defined by the cradle 40 by a predetermined distance. The second water nozzle 62 is positioned lower than the first water nozzle 60. The second water nozzle 62 is disposed to spray washing water around a portion where the first water nozzle 60 is disposed. The second water nozzle 62 may have a hemispherical shape convex inward.

The plurality of second water nozzles 62 may each have a plurality of second spray holes 62*a* and 62*b* through which washing water is sprayed. The plurality of second spray holes 62*a* and 62*b* formed in the second water nozzle 62 are provided in different positions. The plurality of second spray holes 62*a* and 62*b* formed in the second water nozzle 62 may be open to face different directions. Referring to FIG. 11, the second water nozzle 62 may have a 2-1 spray hole 62*a* formed at a center of the hemispherical shape, and a plurality of 2-2 spray holes 62*b* disposed spaced apart in different directions with respect to the 2-1 spray hole 62*a*.

Figure 8:
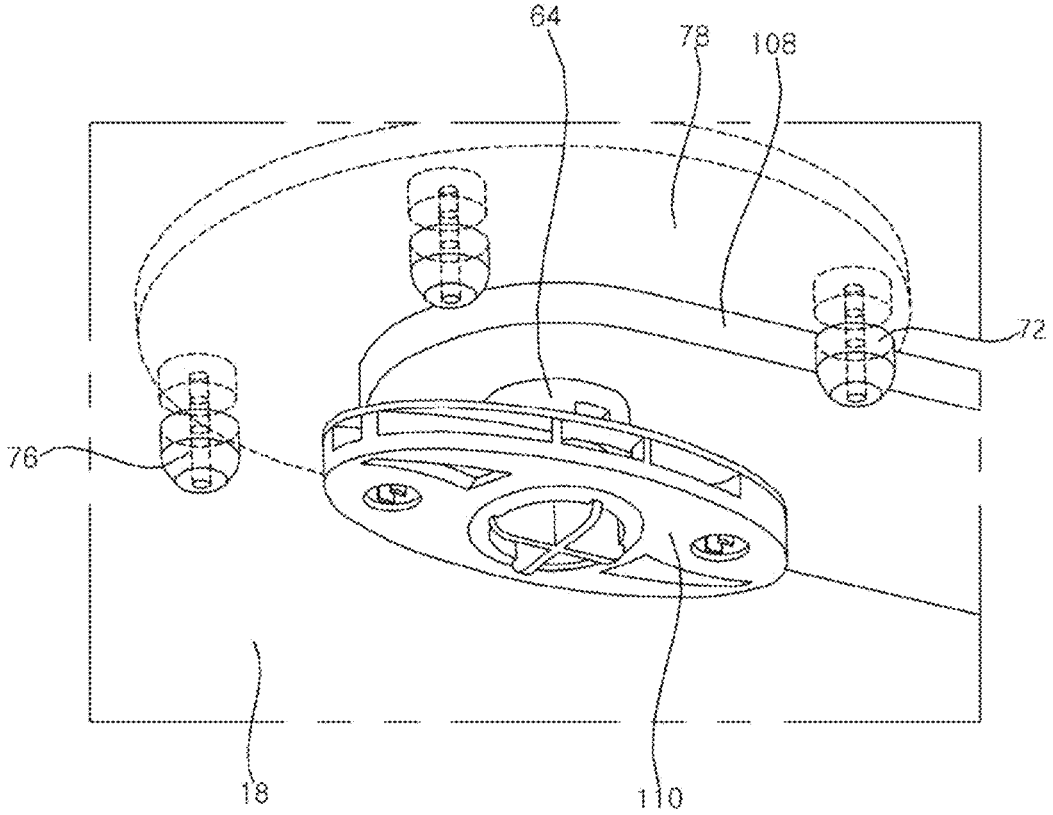
FIG. 8 is a view for explaining the arrangement of a third water nozzle and a second air nozzle, according to an embodiment of the present disclosure.

Referring to FIG. 8, the third water nozzle 64 sprays washing water toward an outside of an object placed in the washing space 10*a*. The third water nozzle 64 is disposed above the object to spray washing water downward.

The third water nozzle 64 is disposed above the first water nozzle 60. As the third water nozzle 64 is disposed above the first water nozzle 60, washing water is sprayed in a direction in which the first water nozzle 60 is disposed. The third water nozzle 64 is disposed at an upper side of the washing space 10*a* to spray washing water downward. The washing water sprayed from the third water nozzle 64 may be scattered to an outside of the washing space by a rotating member 110 to be described later.

The washing apparatus 1 includes a water supply pipe (65, 66, 68) to supply washing water to the first water nozzle 60, the second water nozzle 62, or the third water nozzle 64. The water supply pipe (65, 66, 68) includes a main water supply pipe 65 connected to the water pump 120, a first water supply pipe 66 that is branched from the main water supply pipe 65 and is connected to the first water nozzle 60, and a second water supply pipe 68 that is branched from the main water supply pipe 65 and is connected to the second water nozzle 62 and the third water nozzle 64.

Figure 7:
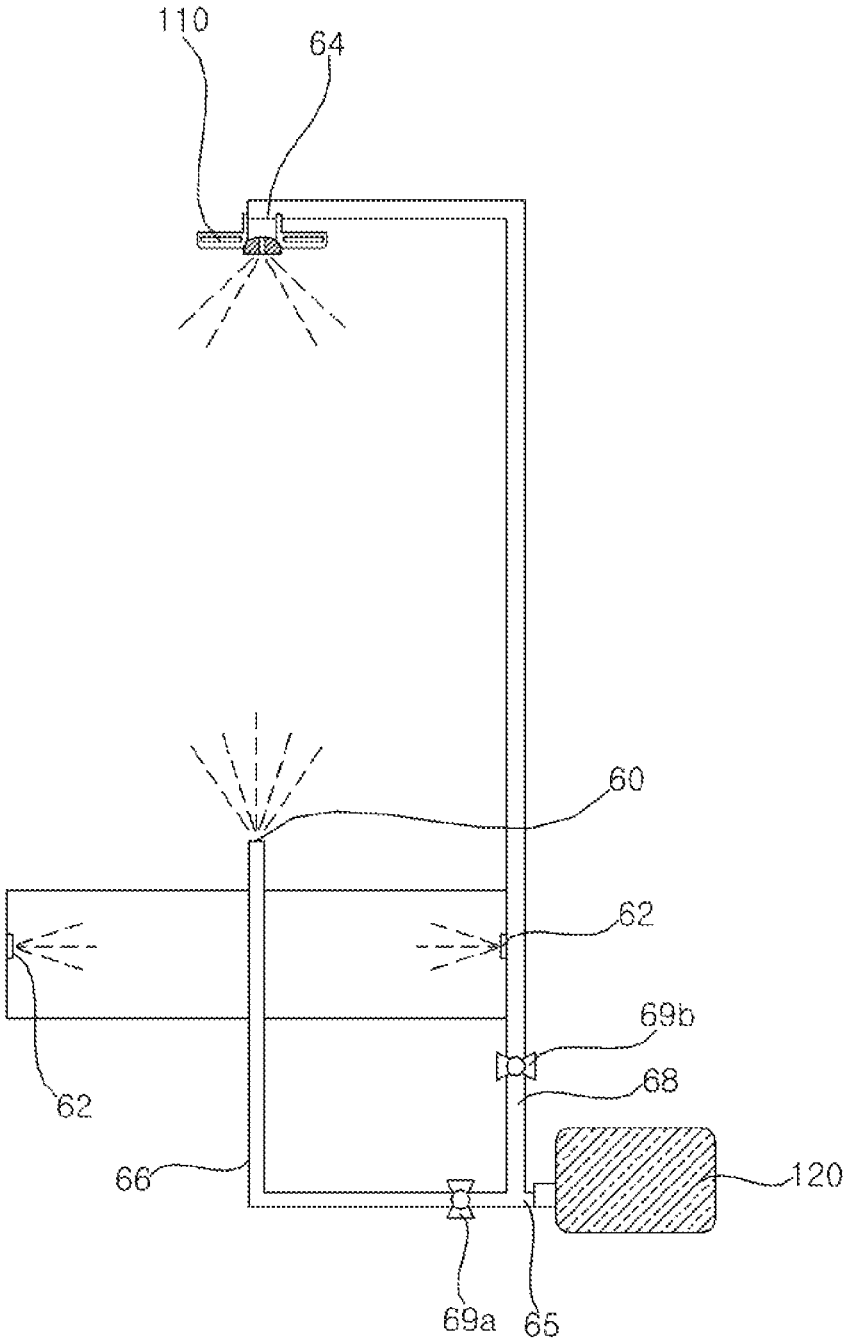
FIG. 7 is a view for explaining the arrangement of a first water nozzle, a second water nozzle, and a third water nozzle, and passages respectively supplied to the first water nozzle, the second water nozzle, and the third water nozzle, according to an embodiment of the present disclosure.

Referring to FIG. 7, the washing apparatus 1 includes a valve (69*a*, 69*b*) to supply washing water to at least one of the first water nozzle 60, the second water nozzle 62, and the third water nozzle 64. The valve (69*a*, 69*b*) may include a first valve 69*a* that opens and closes the first water supply pipe 66, and a second valve 69*b* that opens and closes the second water supply pipe 68.

The first water nozzle 60 is connected to the water pump 120 through the first water supply pipe 66. The first water supply pipe 66 is disposed inside the nozzle support 90 to be described later. The second water nozzle(s) 62 and the third water nozzle 64 are connected to the water pump 120 through the second water supply pipe 68. The second water supply pipe 68 is connected to the nozzle frame 100, thereby allowing washing water to be supplied to the second water nozzle 62 and the third water nozzle 64.

Referring to FIGS. 6 and 8, the air nozzle includes a first air nozzle 70 to spray air to an inner space of an object, and a second air nozzle 72 to spray air to an outside of the object.

Referring to FIG. 6, the first air nozzle 70 is disposed adjacent to the first water nozzle 60. The first air nozzle 70 is disposed at an upper end of the nozzle support 90. The first air nozzle 70 is disposed such that air is sprayed upward from the upper end of the nozzle support 90.

Referring to FIG. 8, the second air nozzle 72 is disposed at an upper wall 18 provided at an upper side of the washing space 10*a*. The top cover 16 is provided at its lower side with the upper wall 18 disposed at the upper side of the washing space 10*a*. A second air supply pipe 76 for supplying air to the second air nozzle 72 may be disposed between the top cover 16 and the upper wall 18.

Referring to FIG. 8, a plurality of second air nozzles 72 may be disposed at an air distributor 78. The air distributor 78 is connected to the second air supply pipe 76, thereby allowing air introduced from the second air supply pipe 76 to be transferred to the plurality of second air nozzles 72. Referring to FIG. 8, the air distributor 78 has a disk shape, and the plurality of second air nozzles 72 are disposed on a lower surface of the air distributor 78. The air distributor 78 is connected at one side to the second air supply pipe 76. The air distributor 78 may be provided therein with branch passages to transfer air introduced from the second air supply pipe 76 to the respective plurality of second air nozzles 72.

The plurality of second air nozzles 72 may be disposed at the upper wall 18. The plurality of second air nozzles 72 may be spaced apart from the third water nozzle 64 at equal intervals. The second air nozzle 72 sprays air toward the washing space 10*a*. The second air nozzle 72 sprays air downward.

The first air nozzle 70 is connected to an air pump 122 through the first air supply pipe 74. The first air supply pipe 74 is disposed inside the nozzle support 90. The second air nozzle 72 is connected to the air pump 122 through the second air supply pipe 76. The second air supply pipe 76 extends upward in a rear space of the mechanical chamber 10*b*. The second air supply pipe 76 extends to a space between an upper surface 92 and the top cover 16. The second air supply pipe 76 may be connected to the air distributor 78 at which the plurality of second air nozzles 72 are provided.

Referring to FIG. 6, the steam nozzle 80 is disposed adjacent to the first water nozzle 60 and the first air nozzle 70. The steam nozzle 80 is disposed on the upper surface of the nozzle support 90. The steam nozzle 80 sprays steam to an inner space of an object placed in the washing space 10*a*. The steam nozzle 80 is spaced upward from the cradle 40, and is disposed to spray steam upward.

The steam nozzle 80 is connected to a steam generator 124 through the steam supply pipe 82. The steam supply pipe 82 is disposed inside the nozzle support 90.

The washing apparatus 1 includes a nozzle support 90 provided with the first water nozzle 60, the first air nozzle 70, and the steam nozzle 80 that are disposed inside the washing space 10*a*.

Referring to FIG. 12, the nozzle support 90 supports the steam supply pipe 82, the first water supply pipe 66, and the first air supply pipe 74 that are disposed therein. The nozzle support 90 has a cylindrical shape and defines therein a space in which the steam supply pipe 82, the first water supply pipe 66, and the first air supply pipe 74 are disposed.

Referring to FIG. 13, the steam nozzle 80 provided at an end of the steam supply pipe 82, the first water nozzle 60 provided at an end of the first water supply pipe 66, and the first air nozzle 70 provided at an end of the first air supply pipe 74 are disposed on the upper surface 92 of the nozzle support 90.

The nozzle support 90 may pass through the nozzle hole 46 of the cradle 40. A lower end of the nozzle support 90 is disposed below the cradle 40, and an upper end of the nozzle support 90 is disposed above the cradle 40. The upper surface 92 of the nozzle support 90 is spaced apart above the cradle 40.

The nozzle support 90 may be fixedly disposed at one side of the cradle 40. The nozzle support 90 may include a support body 94 defining therein a space in which the steam supply pipe 82, the first water supply pipe 66, and the first air supply pipe 74 are disposed, a support base 96 extending radially from a lower end portion of the support body 94, and a holder 98 extending upward from one side of the support base 96 and fixing or securing an object placed around the support body 94.

The support body 94 has a cylindrical shape, and the steam nozzle 80, the first water nozzle 60, and the first air nozzle 70 are disposed at an upper portion thereof. The support base 96 may be fixed at one side to the vertical rib 48 of the cradle 40.

The holder 98 may have a shape extending upward from the lower end of the nozzle support 90. The holder 98 may have a shape in which a distance from the support body 94 decreases upward from the cradle 40. The holder 98 can elastically deform to allow an object to be placed between the holder 98 and the support base 96, and can act as a spring to provide an elastic force against the object to hold the object against the support base 96.

Referring to FIG. 6, the washing apparatus 1 includes a nozzle frame 100 on which the second water nozzle 62 and the third water nozzle 64 are disposed. The nozzle frame 100 may support the arrangement of the second water nozzle 62 configured to spray washing water toward the center from the lower side of the washing space 10*a* and the third water nozzle 62 configured to spray washing water downward from the upper side of the washing space 10*a*.

The nozzle frame 100 is provided at one side with the second water nozzle(s) 62 spaced apart from the nozzle support 90 in the radial direction and configured to spray washing water toward the nozzle support 90, and is provided at another side with the third water nozzle 64 disposed above the nozzle support 90 and configured to spray washing water downward.

The nozzle frame 100 includes the first frame 102 spaced apart from the nozzle support 90 in the radial direction and provided with the second water nozzle 62, and a second frame 104 extending upward from one side of the first frame 102 and provided with the third water nozzle 64.

The first frame 102 may have a ring shape (e.g., circular shape). The second water nozzles 62 are spaced apart in the circumferential direction on the inner circumferential surface 103 of the first frame 102. The second water nozzle 62 is positioned higher than the cradle 40. The second water nozzle 62 may be disposed above the support 40 to be spaced apart by a predetermined distance.

Referring to FIG. 10, a plurality of second water nozzles 62 are disposed on the inner circumferential surface 103 of the first frame 102. The plurality of second water nozzles 62 may be disposed at the same height. The plurality of second water nozzles 62 are spaced apart from each other in the circumferential direction on the inner circumferential surface 103 of the first frame 102. Referring to FIG. 10, the plurality of second water nozzles 62 may be disposed spaced apart with the same phase difference therebetween.

The first frame 102 may be provided therein with a washing passage through which washing water flows. The washing passage formed in the first frame 102 is connected to the plurality of second water nozzles 62, thereby allowing washing water to be supplied to the second water nozzles 62.

The second frame 104 extends upward from one side of the first frame 102. The second frame 104 may extend to an upper end of the washing space 10*a*. The second frame 104 may be connected to the third water nozzle 64 disposed at the upper end of the washing space 10*a*.

The second frame 104 may include a vertical frame 106 extending upward from the first frame 102, and a horizontal frame 108 bent from an upper end of the vertical frame 106 to extend above the nozzle support 90.

The horizontal frame 108 is bent perpendicularly from the upper end of the vertical frame 106 and extends. The horizontal frame 108 is provided with the third water nozzle 64. The third water nozzle 64 is disposed above the first water nozzle 60. The third water nozzle 64 is disposed to spray washing water toward the first water nozzle 60. The rotating member 110 rotated by washing water sprayed from the third water nozzle 64 and configured to scatter washing water sprayed from the third water nozzle 64 may be disposed at an end portion of the horizontal frame 108.

Referring to FIG. 7, the rotating member 110 is rotatably disposed at the second frame 104. The rotating member 110 is rotatably disposed at an end portion of the horizontal frame 108. The rotating member 110 is rotatably disposed at the horizontal frame 108 where the third water nozzle 64 is disposed.

The rotating member 110 is rotated by washing water sprayed from the third water nozzle 64 and scatters the washing water sprayed from the third water nozzle 64 downward.

The water pump 120 for supplying washing water to the first water nozzle 60, the second water nozzle 62, or the third water nozzle 64, the steam generator 124 for supplying steam to the steam nozzle 80, and the air pump 122 for supplying air to the first air nozzle 70 or the second air nozzle 72 are disposed at the mechanical chamber 10*b*.

Figure 5:
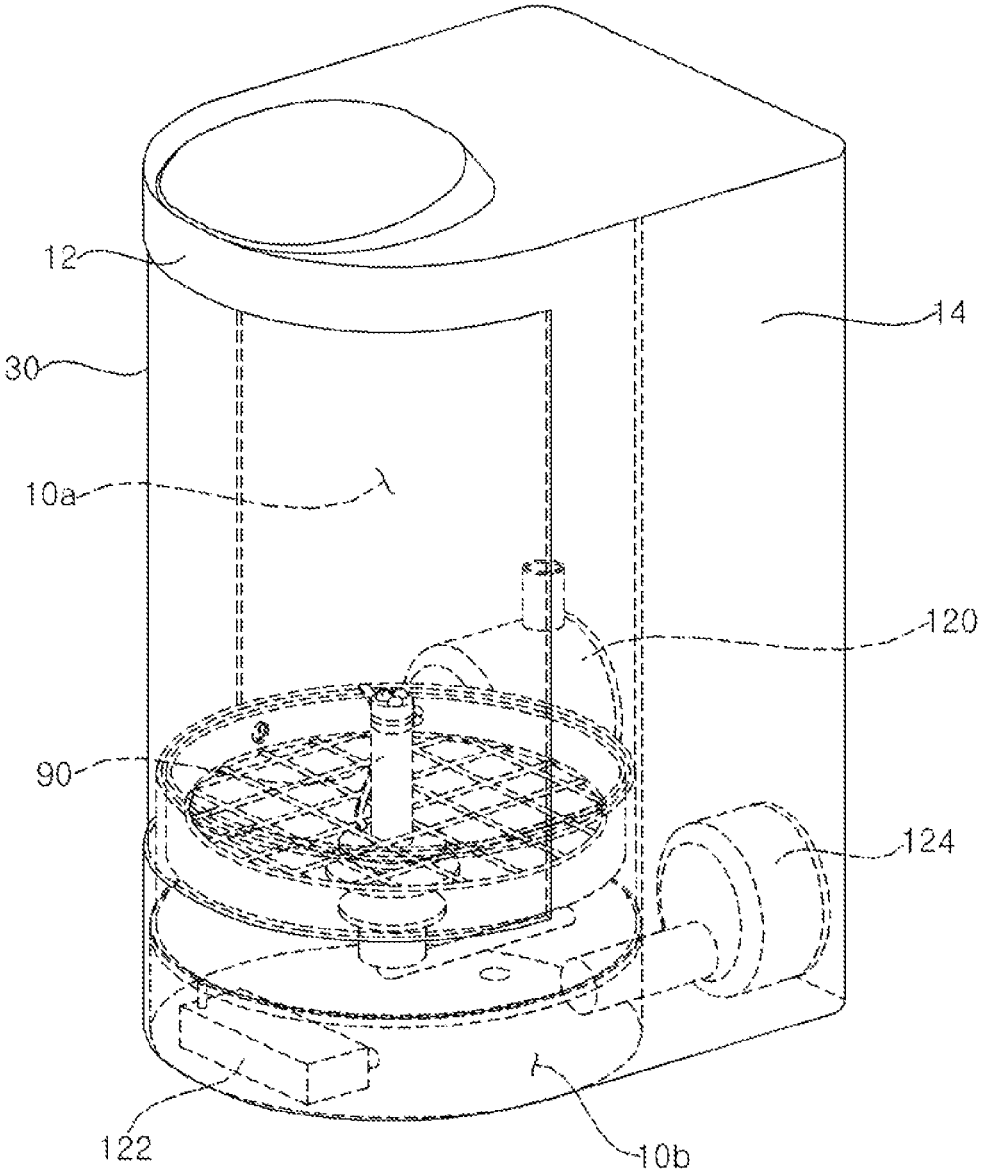
FIG. 5 is a view for explaining the arrangement of a water pump, an air pump, and a steam generator for supplying washing water, air, and steam to a water nozzle, an air nozzle, and a steam nozzle, according to an embodiment of the present disclosure.

Referring to FIG. 5, the water pump 120 may be disposed at a lower rear side of the rear case 14.

The water pump 120 may be connected to the water collecting pipe 52 so as to supply washing water discharged from the water collecting pipe 52 to the first water nozzle 60, the second water nozzle 62, or the third water nozzle 64. In addition, the water pump 120 may be connected to an external water source through a separate connecting pipe so as to receive washing water from the outside.

The steam generator 124 may be connected to the water pump 120 so as to receive part of water pumped by the water pump 120. The steam generator 124 may heat part of washing water supplied from the water pump 120, so as to supply the heated washing water to the steam nozzle 80.

A dispenser 126 for temporarily storing detergent to supply the detergent to the water supply pipe is disposed in the mechanical chamber 10*b*. The dispenser 126 is connected to the water supply pipe through a detergent supply pipe 128. The detergent supply pipe 128 connects the dispenser 126 and the second water supply pipe 68. Detergent stored in the dispenser 126 may be introduced into the washing space 10*a* through the detergent supply pipe 128 and the second water supply pipe 68.

Figure 15:
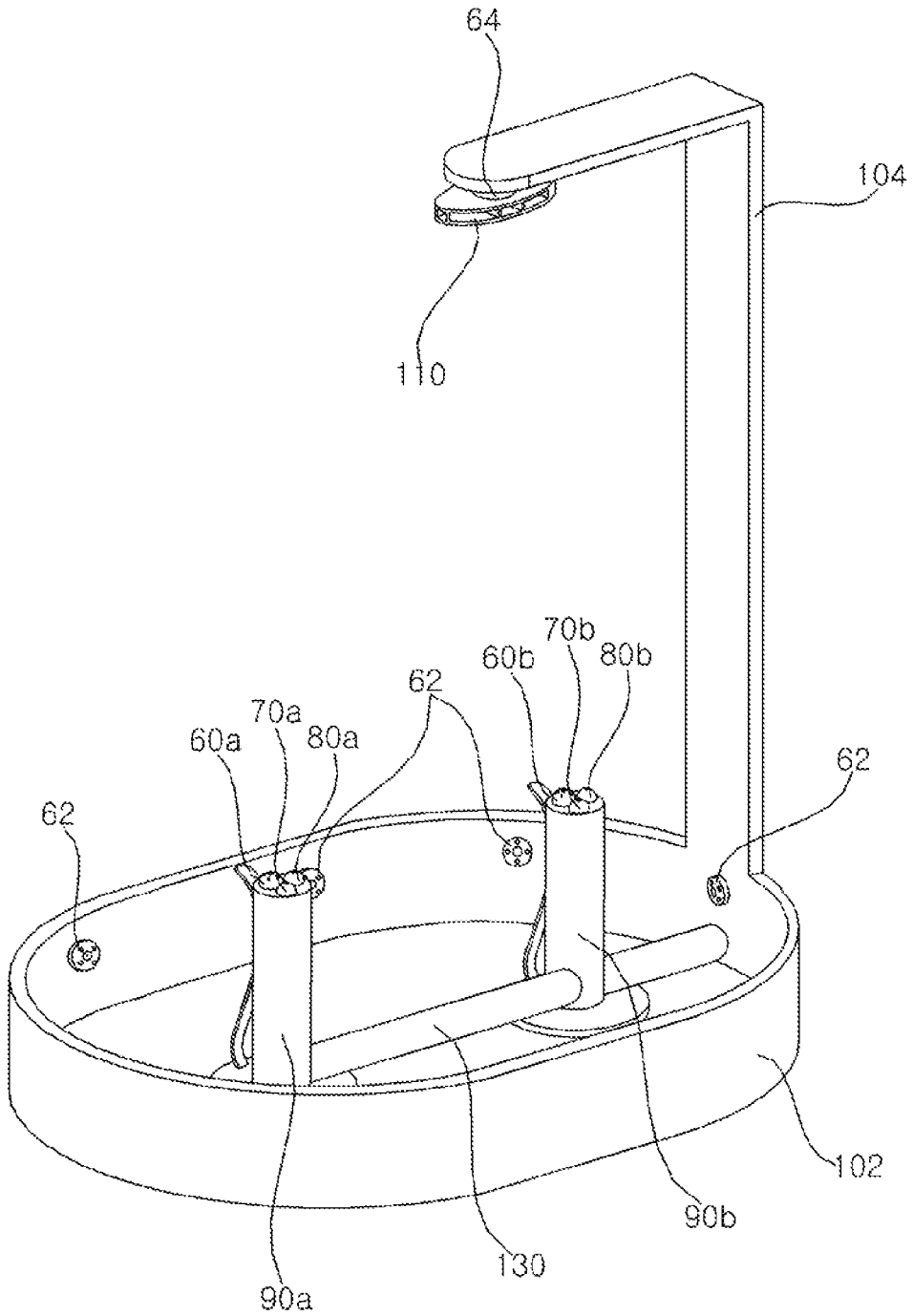
FIG. 15 is a perspective view of a nozzle support and a nozzle frame, according to another embodiment of the present disclosure.
Figure 16:
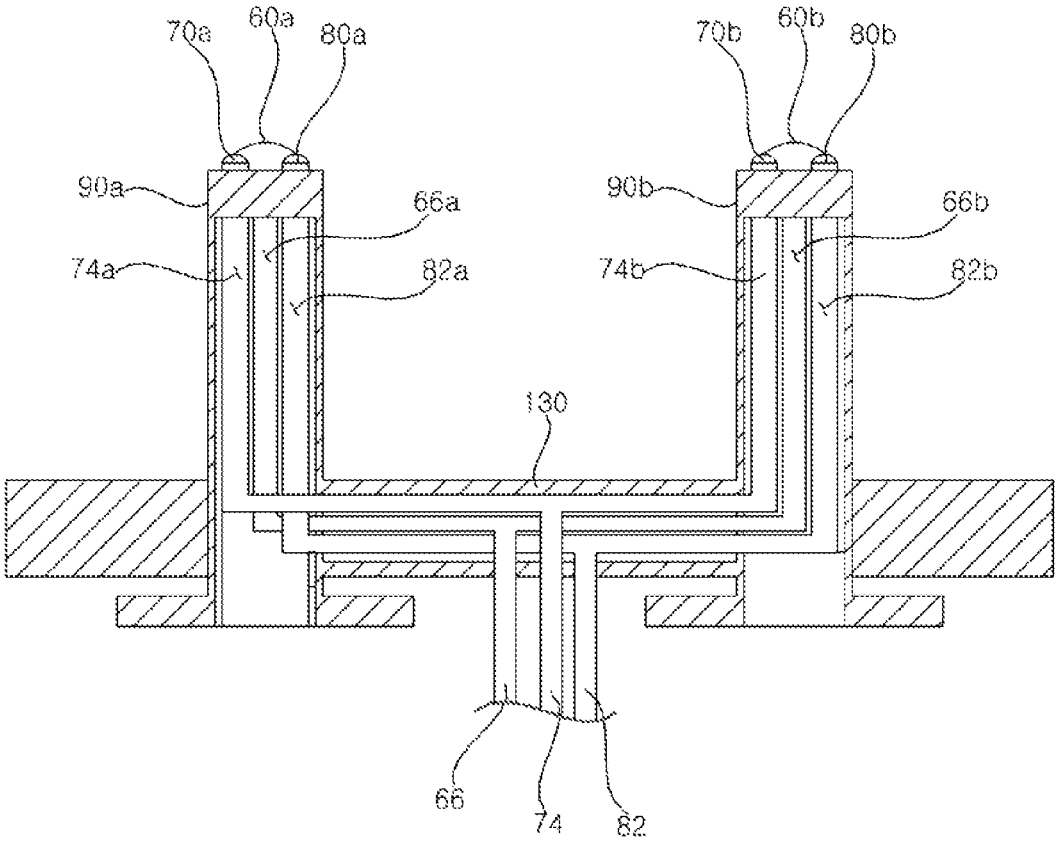
FIG. 16 is a schematic cross-sectional view illustrating a plurality of supply pipes disposed in a nozzle support and a connecting pipe, according to another embodiment of the present disclosure.

A washing apparatus according to another embodiment of the present disclosure will be described with reference to FIGS. 15 and 16. Referring to FIGS. 15 and 16, the washing apparatus will be described based on differences from the washing apparatus described in FIGS. 1 to 13.

The washing apparatus of this embodiment includes a nozzle frame 100 provided with a second water nozzle 62 and a third water nozzle 64, and a plurality of nozzle supports 90*a* and 90*b* provided with a first water nozzle (60*a*, 60*b*). Referring to FIG. 15, the washing apparatus includes a first nozzle support 90*a* and a second nozzle support 90*b* spaced apart from the first nozzle support 90*a*.

Referring to FIG. 15, the nozzle frame 100 includes a first frame 102 at which the second water nozzle 62 is disposed, and a second frame 104 extending upward from one side of the first frame 102 and at which the third water nozzle 64 is disposed.

Referring to FIG. 15, the washing apparatus 1 includes the nozzle frame 100 disposed around the first nozzle supporter 90*a* and the second nozzle supporter 90*b*, and a connecting frame 130 fixed to the nozzle frame 100 and connected to the first nozzle support 90*a* and the second nozzle support 90*b*. Referring to FIG. 15, the washing apparatus 1 includes the connecting frame 130 that is fixed to the first frame 102 and is connected to the plurality of nozzle supports 90*a* and 90*b*. The connecting frame 130 may be disposed at a lower side of a cradle 40.

The connecting frame 130 may be supported by being fixed to one end and another (or opposite) end of the first frame 102. The connecting frame 130 is connected to the plurality of nozzle supports 90*a* and 90*b*. The plurality of nozzle supports 90*a* and 90*b* are spaced apart from each other in a direction in which the connecting frame 130 extends, and are formed upward at an upper end of the connecting frame 130.

Referring to FIG. 15, the first nozzle support 90*a* and the second nozzle support 90*b* that is spaced apart from the first nozzle support 90*a* are connected to the connecting frame 130. The first nozzle support 90*a* and the second nozzle support 90*b* are disposed to protrude upward from the cradle 40.

Referring to FIG. 16, the first nozzle support 90*a* is provided with a 1-1 water nozzle 60*a*, a 1-1 air nozzle 70*a*, and a first steam nozzle 80*a*, and the second nozzle support 90*b* is provided with a 1-2 water nozzle 60*b*, a 1-2 air nozzle 70*b*, and a second steam nozzle 80*b*.

Referring to FIG. 16, the connecting frame 130 is provided with a first water supply pipe 66 for supplying washing water to the 1-1 water nozzle 60*a* and the 1-2 water nozzle 60*b*, a first air supply pipe 74 for supplying air to the 1-1 air nozzle 70*a* and the 1-2 air nozzle 70*b*, and a steam supply pipe 82 for supplying steam to the first steam nozzle 80*a* and the second steam nozzle 80*b*.

The first water supply pipe 66, which is disposed in the connecting frame 130, is branched into a 1-1 water supply pipe 66*a* and a 1-2 water supply pipe 66*b*. The 1-1 water supply pipe 66*a* is connected to the 1-1 water nozzle 60*a*, and the 1-2 water supply pipe 66*b* is connected to the 1-2 water nozzle 60*b*.

The first air supply pipe 74, which is disposed in the connecting frame 130, is branched into a 1-1 air supply pipe 74*a* and a 1-2 air supply pipe 74*b*. The 1-1 air supply pipe 74*a* is connected to the 1-1 air nozzle 70*a*, and the 1-2 air supply pipe 74*b* is connected to the 1-2 air nozzle 70*b*.

The steam supply pipe 82, which is disposed in the connecting frame 130, is branched into a first steam supply pipe 82*a* and a second steam supply pipe 82*b*. The first steam supply pipe 82*a* is connected to the first steam nozzle 80*a*, and the second steam supply pipe 82*b* is connected to the second steam nozzle 80*b*.

The cradle 40 may be provided with two nozzle holes (not shown) through which the first nozzle support 90*a* and the second nozzle support 90*b* pass.

Each of the first nozzle support 90*a* and the second nozzle support 90*b* may include a support body 94 defining a space in which the first water supply pipe 66 is disposed, a support base 96 extending radially from a lower end portion of the support body 94, and a holder 98 extending upward from one side of the support base 96 and fixing an object placed around the support body 94.

Although preferred embodiments of the present disclosure have been shown and described herein, the present disclosure is not limited to the specific embodiments described above. It will be understood that various modifications and changes can be made by those skilled in the art without departing from the idea and scope of the present disclosure as defined by the appended claims. Therefore, it shall be considered that such modifications, changes, and equivalents thereof are all included within the scope of the present disclosure.

The invention claimed is:

1. A washing apparatus comprising:

a case defining an outer appearance, the case including a washing space to wash an object;

a cradle disposed in the washing space, the cradle being for supporting the object;

a first water nozzle spaced apart above the cradle, the first water nozzle being configured to spray washing water in an upwards direction;

a plurality of second water nozzles radially spaced apart from the first water nozzle and being-configured to spray the washing water radially inward towards the first water nozzle;

a nozzle frame having an annular shape and spaced apart from the first water nozzle in a radial direction; and a third water nozzle spaced above the first water nozzle and configured to spray the washing water downward, wherein the plurality of second water nozzles are disposed on an inner circumferential surface of the nozzle frame.

2. The washing apparatus of claim 1, wherein the plurality of second water nozzles are spaced upwards from the cradle.

3. The washing apparatus of claim 1, wherein the first water nozzle is disposed at a position higher than the plurality of second water nozzles.

4. The washing apparatus of claim 1, wherein the first water nozzle has a hemispherical shape convex upwards, and wherein the first water nozzle is provided with a plurality of first spray holes at different positions to spray the washing water in different directions.

5. The washing apparatus of claim 4, wherein the plurality of first spray holes includes a first spray hole formed at a center of the hemispherical shape and a plurality of second first spray holes disposed spaced apart from the first spray hole.

6. The washing apparatus of claim 1, further comprising:

a first water supply pipe to supply the washing water to the first water nozzle; and a nozzle support protruding above the cradle, the first water supply pipe being disposed within the nozzle support, wherein the first water nozzle is disposed at an upper end of the nozzle support.

7. The washing apparatus of claim 6, wherein the cradle includes:

an inner grille including a plurality of linear elements that intersect each other;

an outer grille defining an outer circumferential edge, the inner grille being disposed within the outer grille; and a nozzle hole at a center of the cradle, the nozzle support passing through the nozzle hole.

8. The washing apparatus of claim 1, wherein the nozzle frame includes:

a first frame disposed around the cradle; and a second frame extending upwards from one side of the first frame and forming an "L" shape.

9. The washing apparatus of claim 1, further comprising a rotating member rotatably disposed under the third water nozzle, the rotating member being configured to scatter the washing water, sprayed from the third water nozzle, in the radial direction.

10. The washing apparatus of claim 1, wherein the nozzle frame supports the plurality of second water nozzles and the third water nozzle.

11. The washing apparatus of claim 10, further comprising a nozzle support protruding above the cradle, the nozzle support having an upper end at which the first water nozzle is disposed, wherein the nozzle frame comprises:

a first frame radially spaced apart from the nozzle support, the first frame being provided with the plurality of second water nozzles; and a second frame extending upward from one side of the first frame, the second frame being provided with the third water nozzle.

12. The washing apparatus of claim 11, wherein the plurality of second water nozzles are disposed at a same height on an inner circumferential surface of the first frame, and wherein the first frame has a ring shape.

13. The washing apparatus of claim 11, wherein the second frame includes:

a vertical frame extending upward from the first frame; and a horizontal frame extending horizontally from an upper end of the vertical frame and positioned above the nozzle support, and wherein the third water nozzle is disposed at an end portion of the horizontal frame so as to spray the washing water toward the first water nozzle from above the first water nozzle.

14. The washing apparatus of claim 1, wherein the plurality of second water nozzles are spaced apart from each other in a circumferential direction defined by the nozzle frame, and wherein the plurality of second water nozzles each have a hemispherical shape facing a nozzle support.

15. The washing apparatus of claim 14, wherein each of the plurality of second water nozzles has a plurality of second spray holes at different positions to spray the washing water in different directions.

* * * * *